US006344004B2

(12) United States Patent
Adams et al.

(10) Patent No.: US 6,344,004 B2
(45) Date of Patent: Feb. 5, 2002

(54) GOLF TEE MARKING SYSTEM AND METHOD OF USE

(76) Inventors: Thomas H. Adams, P.O. Box 3092, Rancho Santa Fe, CA (US) 92067; Thomas M. Adams, 1054 Neptune Ave., Encinitas, CA (US) 92024; Christopher R. Adams, 24131 Via San Clemente, Mission Viejo, CA (US) 92692

( * ) Notice: Subject to any disclaimer, the term of this patent is extended or adjusted under 35 U.S.C. 154(b) by 0 days.

(21) Appl. No.: 09/788,183

(22) Filed: Feb. 16, 2001

Related U.S. Application Data

(63) Continuation of application No. 09/353,492, filed on Jul. 13, 1999.

(51) Int. Cl.[7] ..... A63B 69/36
(52) U.S. Cl. ..... 473/387; 473/237
(58) Field of Search ..... 473/387–403, 473/237

(56) References Cited

U.S. PATENT DOCUMENTS 2,908,504 A * 10/1959 Pratt ..... 473/237
3,806,132 A 4/1974 Brandell
4,418,909 A 12/1983 Messana
4,432,551 A 2/1984 Chen
4,637,616 A * 1/1987 Whiting ..... 473/237
4,974,851 A 12/1990 Closser et al.
5,120,358 A * 6/1992 Pippett ..... 473/237
5,356,146 A 10/1994 Blosser
5,597,361 A 1/1997 Hope
5,609,530 A * 3/1997 Butler, Jr. ..... 473/237
5,830,077 A 11/1998 Yavitz

* cited by examiner

*Primary Examiner*—Steven Wong
(74) *Attorney, Agent, or Firm*—Lyon & Lyon LLP

(57) ABSTRACT

The present invention involves a golf tee coated with colored coatings that when struck with a golf club leave a marking that easily identifies where the ball was struck on the club face and the path of the swing, but does not come off in normal handling. The tee leaves a multicolored marking on the club face that is used to show the swing path of a golfer's swing and the point of impact of the tee on the face of the golf club. The tee has a center line or mark that represents the middle, which establishes the optimum hitting area. This line or mark is also an indicator for the golfer to line up in the direction they are trying to hit the ball. On either side of this colored line or mark is a different color that indicates the swing path when shown on the club face.

14 Claims, 10 Drawing Sheets

INSIDE-OUT

OUTSIDE-IN

STRAIGHT-THROUGH

INSIDE-OUT

OUTSIDE-IN

STRAIGHT-THROUGH

| SWING # | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| MARK INTENSITY DARK/MEDIUM/LIGHT NONE | D | M | M | M | D | M | M | M | M | M | D | M | M | D | L | M | M | M |
| VERTICAL AXIS LOW | X | X | | | X | | | X | X | | | X | | | | X | | |
| MIDDLE | | | | X | | X | X | | | X | X | | | X | X | | X | X |
| HIGH | | | | | | | | | | | | | | | | | | |
| HORIZONTAL AXIS HEAL | X | X | X | X | X | | | | X | | | X | X | | | X | | X |
| MIDDLE | | | | | | * X | * X | * X | | X | X | | | X | X | | X | |
| TOE | | | | | | | | | | | | | | | | | | |
| COLOR YELLOW/GREEN/RED | | X | | | X | X | | X | | | X | | | X | | | X | |
| YELLOW/GREEN | | | ** X | | | | | | | | | | | | ** X | | | |
| RED/GREEN | X | | | X | | | X | | X | X | | X | X | | | X | | X |
| BALL FLIGHT PATH STRAIGHT | | | | | | X | | | | X | | X | | | | | X | |
| FADE | | | | | | | | | | | X | | | | X | X | | |
| HOOK | | X | | | X | | | X | | | | | X | | | | | X |
| SLICE | X | | | X | | | X | | | | | | | | | | | |
| DRAW | | | X | | | | | | X | | | | | X | | | | |
| BALL FLIGHT LOW | | | | | | | | | | | | | X | | | | | |
| MEDIUM | X | | X | X | | X | X | | X | | | X | | | X | X | X | X |
| HIGH | | X | | | X | | | X | | X | X | | | X | | | | |

[1] * MOVED STANCE BACK AWAY FROM BALL ONE INCH.

** CLOSED STANCE AND MADE AN INSIDE-OUT SWING PATH.

FIG. 6A

| SWING # | 19 | 20 | 21 | 22 | 23 | 24 | 25 | 26 | 27 | 28 | 29 | | | | | | | |
|---|---|---|---|---|---|---|---|---|---|---|---|---|---|---|---|---|---|---|
| MARK INTENSITY | | | | | | | | | | | | | | | | | | |
| DARK/MEDIUM/LIGHT | D | L | D | D | D | M | M | D | L | D | M | | | | | | | |
| NONE | | | | | | | | | | | | | | | | | | |
| VERTICAL AXIS | | | | | | | | | | | | | | | | | | |
| LOW | | | X | | X | | | | X | | | | | | | | | |
| MIDDLE | X | X | | X | | X | X | X | | X | X | | | | | | | |
| HIGH | | | | | | | | | | | | | | | | | | |
| HORIZONTAL AXIS | | | | | | | | | | | | | | | | | | |
| HEAL | X | | | | X | | | | X | | | | | | | | | |
| MIDDLE | | X | X | | | X | X | X | | X | X | | | | | | | |
| TOE | | | | X | | | | | | | | | | | | | | |
| COLOR | | | | | | | | | | | | | | | | | | |
| YELLOW/GREEN/RED | X | | X | X | | X | | X | | | X | | | | | | | |
| YELLOW/GREEN | | | | | | | | | | | | | | | | | | |
| RED/GREEN | | X | | | X | | X | | X | X | | | | | | | | |
| BALL FLIGHT PATH | | | | | | | | | | | | | | | | | | |
| STRAIGHT | | | X | | | | | X | | | | | | | | | | |
| FADE | X | | | X | | | | | | | | | | | | | | |
| HOOK | | X | | | | | | | | X | | | | | | | | |
| SLICE | | | | | X | | | | X | | | | | | | | | |
| DRAW | | | | | | X | X | | | | X | | | | | | | |
| BALL FLIGHT | | | | | | | | | | | | | | | | | | |
| LOW | | X | | | | | | | | | | | | | | | | |
| MEDIUM | X | | X | | X | | | X | X | | | | | | | | | |
| HIGH | | | | X | | X | X | | | X | X | | | | | | | |

FIG. 6B

| SWING SPEED IN MPH | COLORED TEES MARK INTENSITY DARK/MEDIUM/LIGHT | SWING SPEED IN MPH | WHITE TEES (COMPETITION) MARK INTENSITY DARK/MEDIUM/LIGHT |
|---|---|---|---|
| 71.4 | LIGHT | 47.1 | NONE |
| 71.3 | DARK | 67.2 | MEDIUM/BOTTOM OF CLUB |
| 71.8 | DARK | 100.2 | MEDIUM/BOTTOM OF CLUB |
| 68.9 | DARK | 79.6 | MEDIUM/BOTTOM OF CLUB |
| 59.3 | DARK | 65.8 | MEDIUM/BOTTOM OF CLUB |
| 63.0 | MEDIUM | 57.6 | MEDIUM/BOTTOM OF CLUB |
| 52.0 | MEDIUM | 109.6 | NONE |
| 47.8 | MEDIUM | 64.5 | MEDIUM/BOTTOM OF CLUB |
| 44.1 | LIGHT | 48.8 | NONE |
| 40.4 | DARK | 110.8 | NONE |
| 99.3 | DARK | 100.2 | MEDIUM/BOTTOM OF CLUB |
| 92.1 | DARK | 90.4 | NONE |

FIG. 8

| Size Range of Microcapsules: Each range indicates one swing | Mark Intensity: Light/Medium/Dark/None |
|---|---|
| 300-600 um | Dark |
| 300-600 um | Dark |
| 150-177 um | Dark |
| 150-177 um | Dark |
| 150-177 um | Dark |
| 150-177 um | Dark |
| 150-177 um | Dark |
| 150-177 um | Dark |
| 150-177 um | Dark |

FIG. 10

GOLF TEE MARKING SYSTEM AND METHOD OF USE

This application is a continuation of Ser. No. 09/353,492 filed Jul. 13, 1999.

FIELD OF THE INVENTION

The invention relates, in general, to golfing aids, and, in particular, to devices for identifying and indicating where a golf ball is struck on a club face and the swing path of the golf club.

BACKGROUND OF THE INVENTION

Prior to 1899, when the golf tee was invented, golf balls were teed up on mounds of dirt or grass. Since 1899, there have been numerous inventions in order to tee a golf ball in a reproducible manner. There are also numerous aids that are available to assist the golfer in improving his or her golf stroke. For example, it is useful for the golfer to be able to identify the location on the club face struck by the ball so that the golfer can modify his or her stance, grip or swing to improve the impact location to result in greater distance or avoid hooking or slicing the ball. As with tennis racquets, golf club heads have a "sweet spot," which is the optimum location for striking the ball to provide maximum distance and accuracy. Many golf pros use existing teaching tools such as impact golf tape that is placed on the club face to provide feedback on where the ball was struck. This practice tool is effective, but is banned during a round by USGA rules (rule 4-3). What is needed is a way to achieve these benefits and also conform to USGA rules. Below are patents that help improve the golfer awareness of where on the club face the golf ball was struck and tees that are designed to be height adjustable.

One golfing aid that assists in determining the location of impact of the golf ball on the club head in a golfer's stroke is disclosed in U.S. Pat. No. 5,830,077. It provides an impact detector that is mounted on the club head of a golf club. The impact detector provides an instantaneous visual or audible indicator of the club head face striking the ball.

Another prior device is disclosed in U.S. Pat. No. 4,974,851. This device is a method and apparatus for registering a point of a ball against a surface of a hitting implement. A multi-layered impact indicator is releasably affixed to the striking surface of the implement. The top and bottom layers of the indicator cooperate in a carbonless fashion such that when the ball impacts on the top layer, the impact is communicated to and registered on at least the second layer.

U.S. Pat. No. 5,356,146 is a golf tee that has successive concentric contrasting color stripes around most of the length of a tee. This helps determine at a glance how many of the stripes are exposed above the ground thereby determining the height of a golf ball prior to striking the ball. These stripes are arranged in repeated sequences of two or more different colors in each sequence.

U.S. Pat. No. 4,418,909 is a golf tee for improved straighter golf ball flight when hit therefrom including an adhesive means applied to all or a portion of the socket portion of the head for adherence to the golf ball placed thereon. Golf ball adhesion to the head of this golf tee provides the anti-spin characteristics necessary to reduce ball "hook" or "slice."

U.S. Pat. No. 4,432,551 is a golf alignment marker system which is disclosed wherein a calibrated grid is provided on a strip of paper which provides a mark on impact, and the paper is mounted adjacent the golf ball. A golf club strikes the paper and the ball, and a mark is imparted to the paper surface adjacent the grid.

U.S. Pat. No. 38,006,132 is a golf practice aid embodying a member having adhesive of different tackiness on opposite sides thereof, whereby the member may be secured to a golf ball by the less sticky adhesive in position where the face of the golf club head will strike the stickier adhesive during the golf swing of the club, thereby causing the member to be removed from the ball and transferred to the face of the club to mark the portion thereof which struck the ball.

U.S. Pat. No. 5,597,361 is a golf club strike indicator that uses a self-adhesive indicator, which adheres to a golf club face to provide an indication of the point of impact of the golf ball on the club face is provided. It consists of a sandwich of various layers—a layer of pressure-sensitive adhesive on the bottom, followed by a layer of energy-absorbing elastometric material on which is provided a film of a thermochromic material such as a temperature sensitive liquid crystal. This product is sold as the product Accu-Master, the golf targeting system, which is endorsed by Butch Harmon.

The Physics of Golf written by Theodore P. Jorgensen discloses a method for identifying the impact spot by applying a small dab of watercolor paint to the ball and observing the paint on the club head after a swing.

SUMMARY OF THE INVENTION

The present invention involves a golf tee that is coated with colored special coatings that when struck with a golf club leaves a marking that easily identifies where the ball was struck on the club face and the path of the swing, but does not come off the tee in normal handling. The tee leaves a multi-colored marking on the club face that is used to show the swing path of a golfer's swing and the point of impact of the tee on the face of the golf club. The tee has a line or marking that represents the middle, which establishes the optimum hitting area. This line or marking is also an indicator for the golfer to line up in the direction they are trying to hit the ball. On either side of this line or marking is a different color that indicates the swing path when shown on the club face.

The tee may be one of many tees having a different colored mark scheme, each for a different shot, that are included with a scoring card as part of a tee marking kit. The kit may be used for recording the impact and swing path for tee shots during golf or practice shots.

Along with the tee, a marking indicator may be placed on the club face of a golf club to indicate where the tee should leave a mark for an optimal hit. For example, the mark on the club head will be generally below the initial "sweet spot" indicator that is popular with many of today's clubs. When a perfect shot is made, a marking from the tee is visible within the marking indicator. Because the tee of the present invention does not require a foreign material between the ball and the club face, the tee can be used during a round, without violating USGA rules, as well as on the practice tee.

BRIEF DESCRIPTION OF THE DRAWINGS

FIGS. 6A and 6B are a table listing the intensities of the marks, vertical golf ball impact locations, horizontal golf ball impact location, the color combinations of the marks, the ball flight path and flight for a number of test swings using the golf tee illustrated in FIG. 1A;

FIG. 8 is a table comparing the mark intensity left by colored tees constructed in accordance with an embodiment of the invention versus the mark intensity left by standard white competition tees for different swing speeds.

FIG. 10 is a table showing the resulting marking intensity on a clubface for a number of golf swings where microcapsules of different sizes were used in conjunction with paint as the mark on the tee.

DESCRIPTION OF THE PREFERRED EMBODIMENTS OF THE INVENTION

Figure 1A:
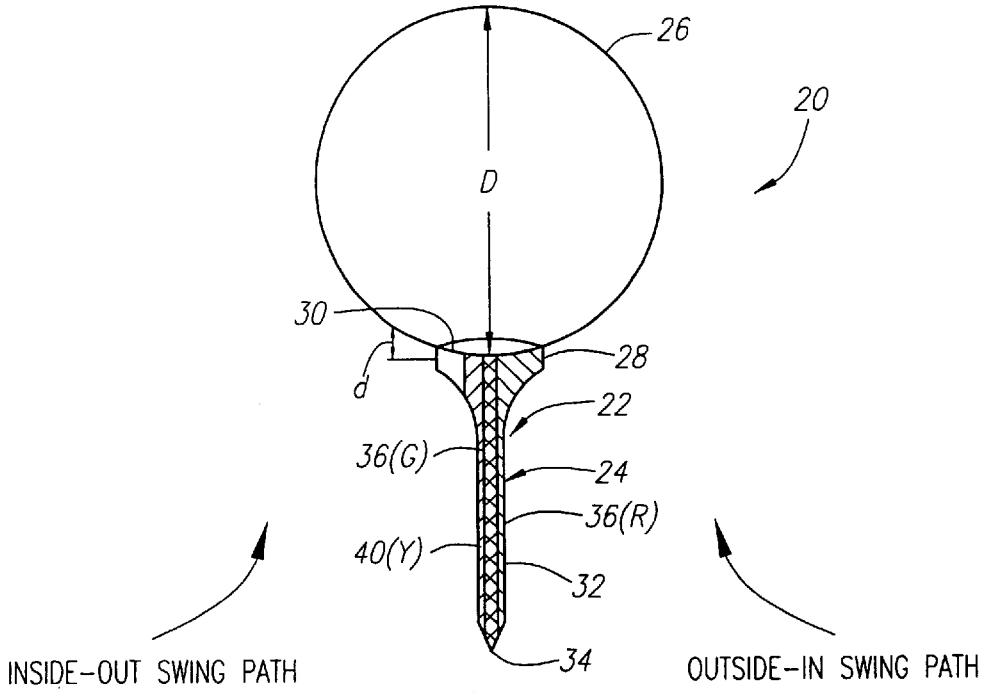
FIG. 1A is a side elevational view of a golf tee constructed in accordance with an embodiment of the invention with a golf ball positioned thereon and illustrates an outside-in swing path and an inside-out swing path for a right-handed golf swing where the swing is into the page.

With reference to FIG. 1A, an improved golf tee marking system 20 constructed in accordance with an embodiment of the invention will now be described. The golf tee marking system 20 is comprised of a golf tee 22 having at least one colored mark 24 located thereon. The golf tee 22 carries a golf ball 26 having a diameter D.

The golf tee 22 is made of a suitable golf tee material such as wood, plastic, nylon or the like. The tee 22 includes a head 28 with an upwardly concaved surface or socket 30 having a depth d. The head 28 preferably has a generally round shape. However, the head 28 may have other shapes such as, but not by way of limitation, generally eliptical or generally hemispherical. The concave top surface 30 may include a generally horizontal line or other mark for aligning the tee 22 with the intended flight direction of the golf ball. A straight stem 32 extends from the head 28 and terminates in a pointed tip 34.

At least one colored mark 24, e.g., three, are preferably vertically oriented and extend from the concave surface 30 of the head 28 to the tip 34 of the stem 32. As used herein, "mark" refers to a line, symbol, sign, etc. on the tee. Although three vertical colored marks 24 are described, it will be readily apparent to those skilled in the art that the golf tee marking system 20 may include marks other than vertical lines and include a number of marks other than three, e.g., one, two, four, etc.. Further, the marks 24 need not extend from the head 28 to the tip 24. The marks 24 may extend, for example, only along the head 28. In the embodiment of the invention illustrated in FIG. 1A, the colored marks 24 may include three vertical lines painted along the vertical axis of the tee 22. The marks 24 include a vertical red line 36(R) or first mark on a right portion of the tee 22, a vertical green line 38(G) or second mark on a central portion of the tee 22 and a vertical yellow line 40(Y) or third mark on a left portion of the tee 22. Of course, colors other than those described herein and color combinations other than those described may be used. The marks 24 may be made of a flat enamel based paint such as Testor flat enamel based paint made by The Testor Corporation of Rockford, Ill. The marks 24 are preferably made of a paint or other material that is transferred onto a club face 42 of a club head 44 (FIG. 1B) when the club face 42 strikes the golf ball 26 and tee 22 so that a temporary record or indication, i.e., marking, is made on the club face 42 representative of where the ball 26 was struck and the flight path of the swing. As used herein, "marking" refers to the resulting line(s), symbol (s), sign(s), color(s), etc. left on the club face 42 by the at least one mark of the tee from a swing. The marks 24 are designed so as not to be readily wiped off of the tee 22, e.g., normal handling of the tees won't cause the marks 24 to run. However, the resultant markings on the club face 42 should be able to be easily wiped off with a damp cloth or the like. Because there is a wide discrepancy between professional and amateur golfer's swing speeds, there is a need to make the tee 22 viable for a golfer, regardless of one's club head speed. The marks 24 on the tee 22 are designed to leave a mark for golfers that have a swing speed as low as about 50 miles per hour (mph) to over 160 mph. This is important because the tee 22 is a teaching instrument and not every golfer can achieve the swing speed of a professional.

The marks 24 may also be made out of a microencapsulated oil or water-soluble dye. The microcapsules may be 1 to 1000 microns in size and have walls made of varying materials depending on their function. Examples of wall materials are gelatin and polyphosphate, gelatin and gum arabic, and gelatin and CMC. Microencapsulation is the envelopment of small solid particles, liquid droplets, or gas bubbles with a coating. The particles encapsulated are called the core, active agent, active, internal phase, nucleus, payload or fill. The coating surrounding the core may consist of an organic poylymer, hydrocolloid, sugar, wax, fat, metal or inorganic oxide.

Figure 1D:
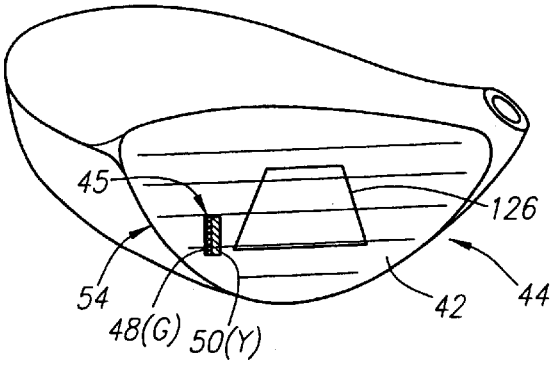
FIG. 1D is a perspective view of a golf club head and illustrates the location of the tee marking left from the tee illustrated in FIG. 1A when the golf ball is struck by the toe portion of the club face with an inside-out swing path for a right-handed golf swing.
Figure 1C:
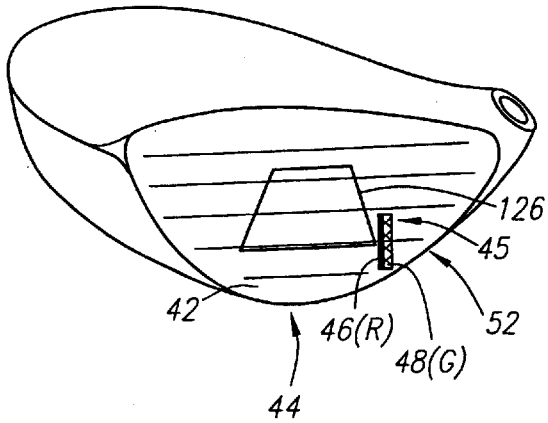
FIG. 1C is a perspective view of a golf club head and illustrates the location of the tee marking left from the tee illustrated in FIG. 1A when the golf ball is struck by the heel portion of the club face with an outside-in swing path for a right-handed golf swing.
Figure 1B:
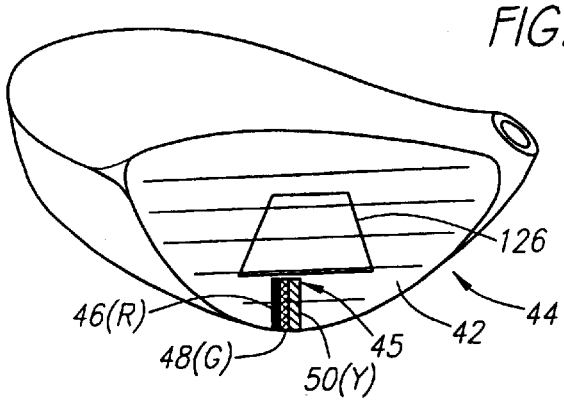
FIG. 1B is a perspective view of a golf club head and illustrates the location of the tee marking left from the tee illustrated in FIG. 1A when the golf ball is struck by the middle portion of the club face with a straight-through shot.

The tee marking system 20 of the present invention will now be described in use. A golf ball is 1.68 inches in diameter. When the golf ball 26 is hit perfectly, the tee 22 places a marking 45 (FIG. 1B) on the club face 44 half the diameter D of the golf ball 26 minus the depth d of the tee socket 30 below a "sweet spot" 126, i.e., the ideal location on the club face 42 to hit the golf ball 26, or approximately 0.8 inches from the "sweet spot." Variations in the location and or color combination of the marking are a result of an inconsistent swing or an incorrect set up. The green center line 38(G) may be used as the aiming feature of the tee 22, instead of or in conjunction with a mark on the top of tee 22 as described above, after the tee 22 is placed in the ground, for lining up the tee 22 with the intended landing area. The contrasting colors 36(R) and 40(Y) on both sides of the center line 38(G) are used for determining the swing path for a shot. The red line 36(R) is used to indicate if a golf club swing path is coming too far outside, for a right-handed swing into the page as shown. The yellow line 40(Y) indicates if the swing path is coming too far from the inside for a right-handed swing. For a left-handed swing, the opposite would be true, i.e., the red line 36(R) is used to indicate an inside-out swing and the yellow line 40(Y) is used to indicate an outside-in swing. When the "sweet spot" is hit with the correct swing path, a resulting marking including colors from all three lines 24 appears on the club face 42 of the golf club head 44 (FIG. 1D). With reference to FIG. 1C, if the club face 42 has a marking 45 with essentially only a resulting green line 48(G) and red line 46(R), this indicates that the swing path was from the outside-in. A slice or fade is usually associated with an outside-in swing path. With an outside-in swing, contact with the ball 26 usually occurs near the heel portion 52 of the club face 42. With reference to FIG. 1D, if the club face 42 has a marking 45 with essentially only a resulting green line 48(G) and yellow line 50(Y), the swing path is from the inside-out. A hook or draw is usually associated with an inside-out swing path. With an inside-out swing, contact with the ball 26 usually occurs near the toe portion 54 of the club face 42. Thus, for a right-handed swing, a resulting red marking 46(R) on the club face 42 indicates an outside-in swing (FIG. 1C) and a resulting yellow marking 50(Y) on the club face 42 indicates an inside-out swing (FIG. 1D). As indicated above, the opposite is true for a left-handed swing.

Accordingly, the tee 22 of the present invention not only shows the golfer where on the club face 42 the ball 26 was struck, but also what type of swing occurred. This provides the feedback needed to correct one's swing in order to hit the ball 26 optimally. For example, golf instructors have determined the following corrections traditionally help a golfer hit the ball on the "sweet spot" of the club face 42 for each of the following indicated shot problems.

If a golfer is hitting a "fat or pop up" shot the possible causes for this common occurrence could be the following: 1) The arms collapse on the top of the swing; 2) Weight stays back on the back leg; 3) The golfer is reaching too early from the top of the swing; 4) Arms are breaking down. To correct this problem a golfer should: 1) Make a wider arc in their back swing; 2) Transfer weight to the left side; 3) Uncoil their body after their initial backswing.

If a golfer is hitting a shot thin the possible causes are: 1) The weight stays on the front leg; 2) The ball is too far back in their stance; 3) The head is in front of the ball. To alleviate this problem a golfer should: 1) Transfer weight to the right leg during the backswing; 2) Get the left shoulder behind the ball; 3) Uncoil all the way through the swing.

If a golfer is hitting the ball on the toe of the club the possible causes could be: 1) the swing path is too inside-out; 2) flipping the hands over; 3) Stance is too far from the ball; 4) Swinging too fast. To fix this problem a golfer should try: 1) Taking the club straight back on the take away; 2) Finish the swing with the right hand facing the target (for a right-handed golfer).

If a golfer is hitting over the top or on the heel a golfer could be: 1) having the back arm and shoulder come out and around the ball; 2) An out-to-in swing path; 3) Too close to the ball. To fix this problem a golfer should: 1) Close their stance; 2) Swing inside and release club to the outside.

Figure 2A:
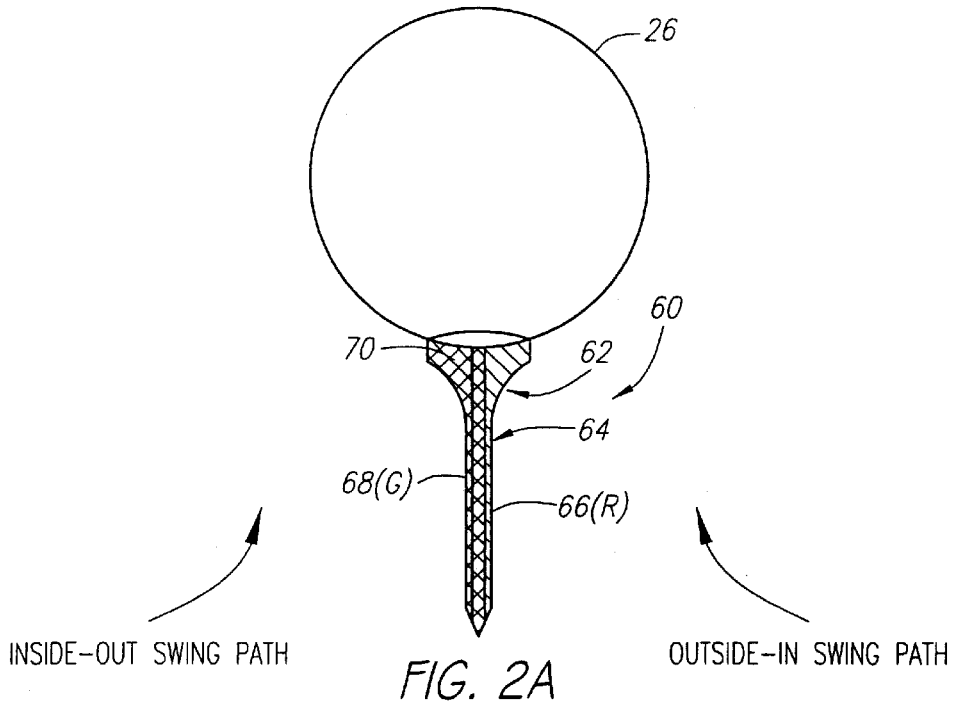
FIG. 2A is a side elevational view of a golf tee constructed in accordance with an alternative embodiment of the invention with a golf ball positioned thereon and illustrates an outside-in swing path and an inside-out swing path for a right-handed golf swing into the page.
Figure 2D:
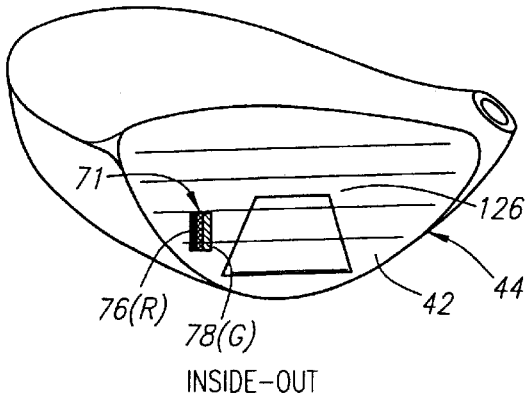
FIG. 2D is a perspective view of a golf club head and illustrates the location of the tee marking left from the tee illustrated in FIG. 2A when the golf ball is struck by the toe portion of the club face with an inside-out swing path for a right-handed golf swing.
Figure 2C:
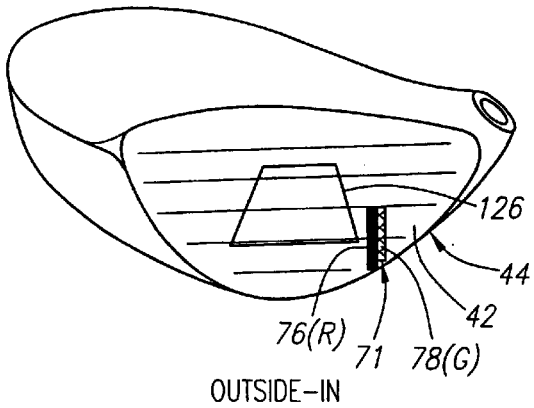
FIG. 2C is a perspective view of a golf club head and illustrates the location of the tee marking left from the tee illustrated in FIG. 2A when the golf ball is struck by the heel portion of the club face with an outside-in swing path for a right-handed golf swing.
Figure 2B:
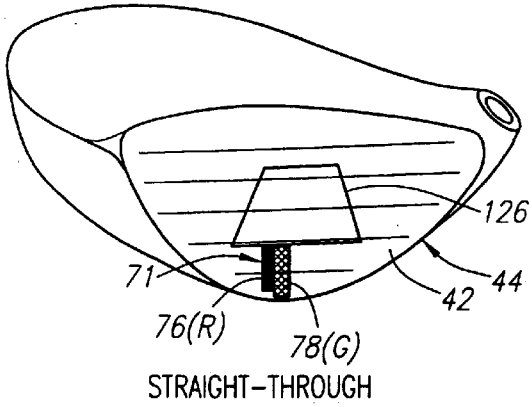
FIG. 2B is a perspective view of a golf club head and illustrates the location of the tee marking left from the tee illustrated in FIG. 2A when the golf ball is struck by the middle portion of the club face with a straight-through shot.

With reference to FIGS. 2A–2D, a tee marking system 60 constructed in accordance with an additional embodiment of the invention will be described. A tee 62 includes two vertical marks 64, a red mark 66(R) or first mark on a right portion of the tee 62 and a green mark 68(G) or second mark on a left portion of the tee 62, for determining impact location and swing path for a golf shot. A middle line 70, where the two marks meet, is used as the direction indicator for setting up the shot. With reference to FIG. 2B, when a golfer hits the ball 26 straight through, the tee 62 leaves a marking 71 with two generally symmetrical lines or markings, a red line 76(R) and a green line 78(G), indicating a straight shot. With reference to FIG. 2C, if a right-handed golfer hits a shot that is too outside-in, a marking 71 including a red line 76(R) wider than a green line 78(G) will result. With reference to FIG. 2D, if the right-handed golfer hits a shot that is too inside-out, a marking 71 including a green line 78(G) wider than a red line 76(R) will result. Of course, the opposite will be true for a left-handed golfer. Thus, similar to the tee 22 described above, the tee 62 indicates impact location and swing path. Based on this information, the golfer's swing, stance, grip, etc. may be adjusted so that a straighter, more consistent swing is achieved.

Figure 3A:
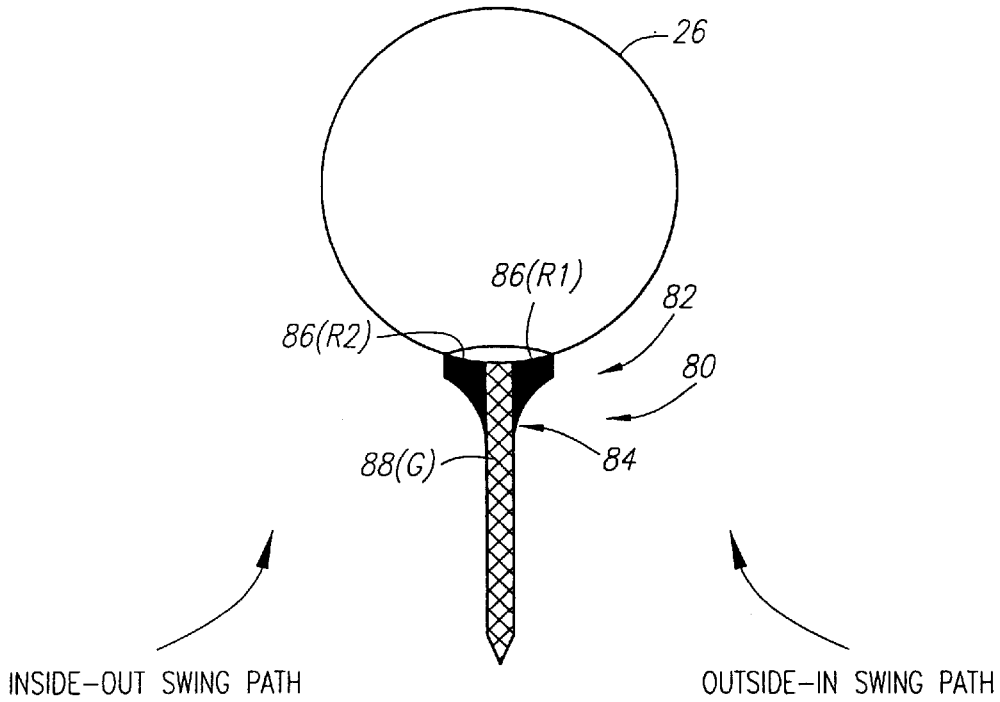
FIG. 3A is a side elevational view of a golf tee constructed in accordance with an additional embodiment of the invention with a golf ball positioned thereon and illustrates an outside-in swing path and an inside-out swing path for a right-handed golf swing into the page.
Figure 3D:
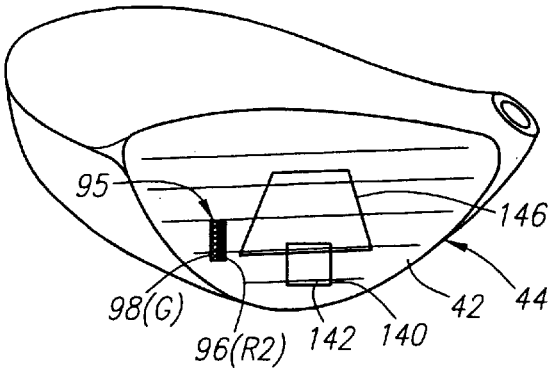
FIG. 3D is a perspective view of a golf club head and illustrates the location of the tee marking left from the tee illustrated in FIG. 3A when the golf ball is struck by the toe portion of the club face with an inside-out swing path for a right-handed golf swing.
Figure 3C:
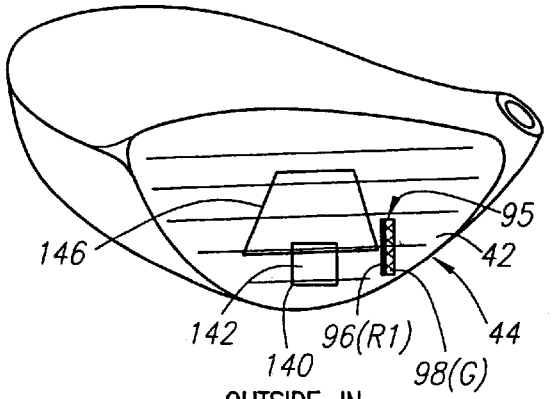
FIG. 3C is a perspective view of a golf club head and illustrates the location of the tee marking left from the tee illustrated in FIG. 3A when the golf ball is struck by the heel portion of the club face with an outside-in swing path for a right-handed golf swing.
Figure 3B:
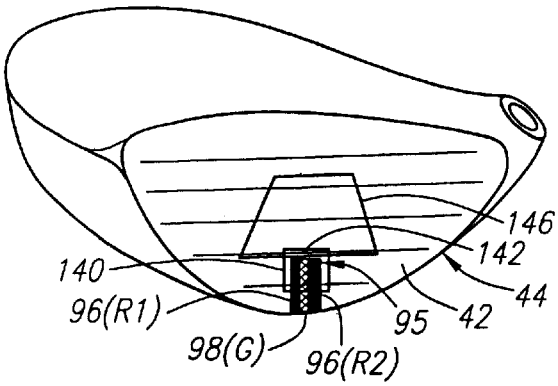
FIG. 3B is a perspective view of a golf club head and illustrates the location of the tee marking left from the tee illustrated in FIG. 3A when the golf ball is struck by the middle portion of the club face with a straight-through shot.

With reference to FIGS. 3A–3D, a tee marking system 80 constructed in accordance with a further embodiment of the invention will be described. A tee 82 includes three marks 84 having two different colors, a first red mark 86(R1) or first mark, a green center mark 88(G) or second mark and a second red mark 86(R2) or third mark for determining impact location and swing path. The green mark 88(G) is used as a guiding indicator for aligning the tee 82 with the landing area. With reference to FIG. 3B, when a golfer hits the ball straight-through, the tee 82 leaves a symmetrical marking 95 consisting of, from left to right, a first red line 96(R1), a green line 98(G) and a second red line 96(R2). With reference to FIG. 3C, when a right-handed golfer hits a shot that is too outside-in, the tee 82 leaves a marking 95 with a first left-to-right color order of a first red line 96(R1) and a green line 98(G). With reference to FIG. 3D, when a right-handed golfer hits a shot that is too inside-out, the tee leaves a marking 95 with a second left-to-right color order of a green marking 98(G) and a second red marking 96(R2). Of course, the opposite is true for a left-handed swing. Thus, similar to the tees 22, 62 described above, the tee 82 indicates impact location and swing path. Based on this information, the golfer's swing, stance, grip, etc. may be adjusted so that a staighter, more consistent swing is achieved.

Figure 4A:
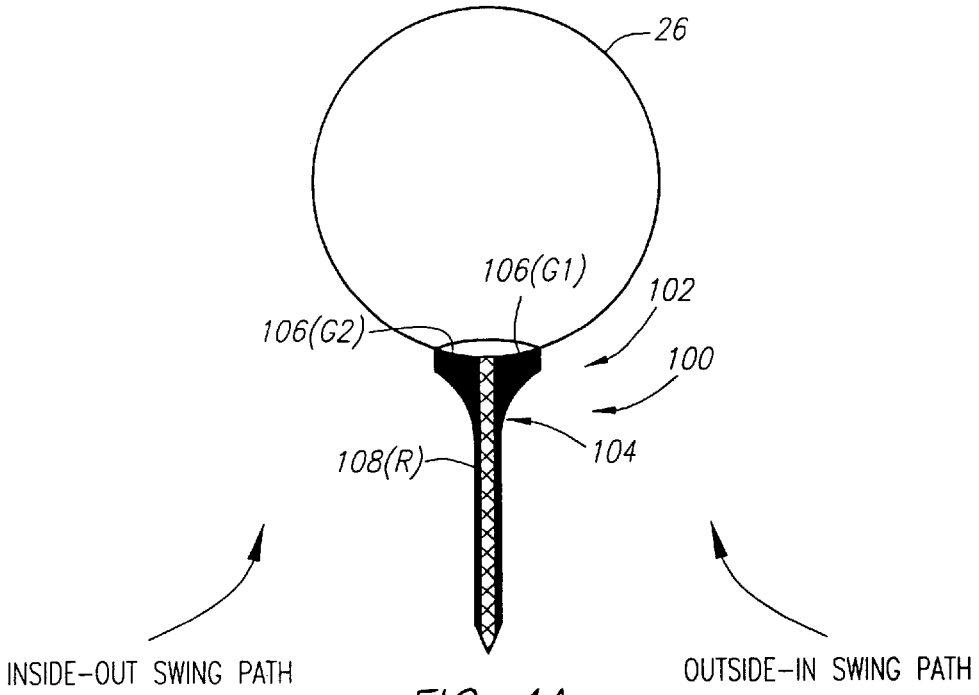
FIG. 4A is a side elevational view of a golf tee constructed in accordance with a further embodiment of the invention with a golf ball positioned thereon and illustrates an outside-in swing path and an inside-out swing path for a right-handed golf swing into the page.
Figure 4D:
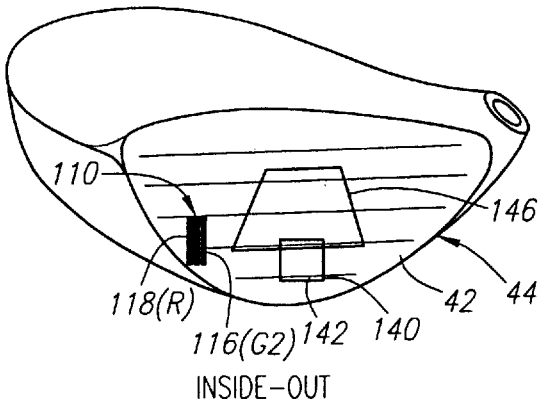
FIG. 4D is a perspective view of a golf club head and illustrates the location of the tee marking left from the tee illustrated in FIG. 4A when the golf ball is struck by the toe portion of the club face with an inside-out swing path for a right-handed golf swing.
Figure 4C:
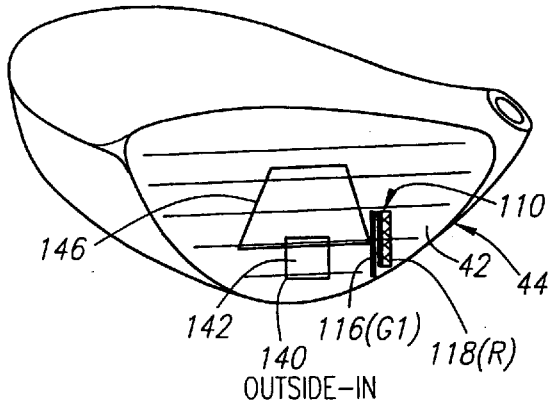
FIG. 4C is a perspective view of a golf club head and illustrates the location of the tee marking left from the tee illustrated in FIG. 4A when the golf ball is struck by the heel portion of the club face with an outside-in swing path for a right-handed golf swing.
Figure 4B:
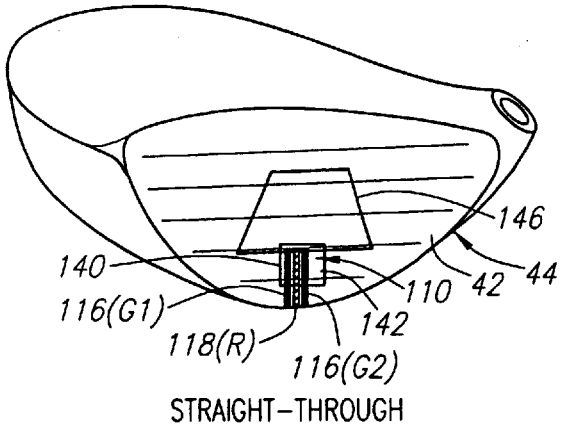
FIG. 4B is a perspective view of a golf club head and illustrates the location of the tee marking left from the tee illustrated in FIG. 4A when the golf ball is struck by the middle portion of the club face with a straight-through shot.

With reference to FIGS. 4A–4D, a tee marking system 100 constructed in accordance with a still further preferred embodiment of the invention will be described. A tee 102 includes three marks 104 having two different colors, a first green mark 106(G1) or first mark, a red center mark 108(R) or second mark and a second green mark 106(G2) or third mark for determing impact location and swing path. The red mark 108(R) is used as a guiding indicator for aligning the tee 102 with the landing area. In this embodiment, although the tee is described has having three marks 104, the tee 102 may also be considered to have one mark because the tee 102 is initially painted or marked with a solid green color and then stamped with a red mark or line 108(R). With reference to FIG. 4B, when a golfer hits the ball straight-through, the tee 102 leaves a symmetrical marking 110 consisting of, from left to right, a first green line. 16(G1), a red line 118(R) and a second green line 116(G2). With reference to FIG. 4C, when a right-handed golfer hits a shot that is too outside-in, the tee 102 leaves a marking 110 with a first left-to-right color order of a first green line 116(G1) and a red line 118(R). With reference to FIG. 4D, when a right-handed golfer hits a shot that is too inside-out, the tee leaves a marking 110 with a second left-to-right color order of a red marking 118(R) and a second green marking 116(G2). Of course, the opposite is true for a left-handed swing. Thus, similar to the tees 22, 62, 82 described above, the tee 102 indicates impact location and swing path. Based on this information, the golfer's swing, stance, grip, etc. may be adjusted so that a staighter, more consistent swing is achieved.

Although the golf tee marking system of the present invention has been described in conjuction with specific colors, color combinations, numbers of marks and types of colored mark, it will be readily apparent to those skilled in the art that other colors, color combinations, numbers of marks and types of colored marks may be used on a golf tee without departing from the spirit or scope of the present invention.

Figure 5:
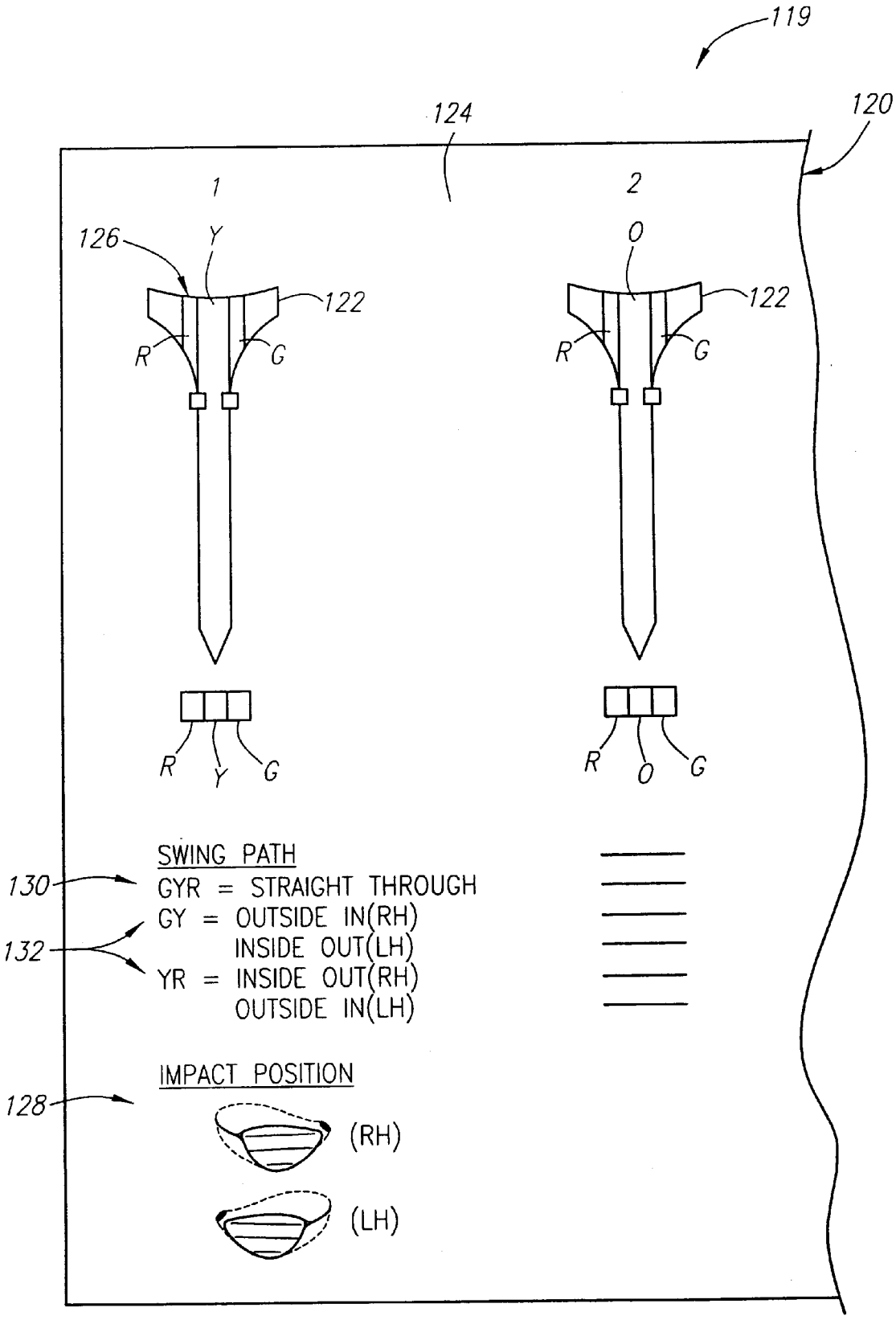
FIG. 5 is a side elevational view of a golf tee marking kit constructed in accordance with an embodiment of the invention.

With reference to FIG. 5, an additional aspect of the present invention involves a tee marking system 119 comprising a tee marking kit 120 including a set of tees 122 such as those described above, one specific for each shot, and a score card 124 for recording the impact position and swing path (along with any other desired information) for a number of shots. Each tee 122 includes at least one mark 126 with a distinctive color scheme that corresponds to a particular shot on the score card 124. The kit 120 may be designed for a round of golf, in which case the kit 120 may include a scoring card and a round of tees (18), each tee with a different color scheme, e.g., different center color, to provide a full record of a round of tee shots. The scoring card may have any number of features to improve the usefulness of the tees 122 such as, but not by way of limitation, a section 128 having a graphic representation of one or more club faces, e.g., right handed (RH), left handed (LH), for recording impact position, a section 130 for recording swing path, i.e., inside-out, outside-in, straight-through, a section for recording ball flight path, i.e., straight, fade, hook, slice, draw, and a section for recording ball flight, i.e., low, medium, high. The scoring card 124 may also include a menu section 132 for indicating what type of swing each resulting color combination marking on the club face 42 represents. A scoring card and set of tees with different color combinations may be used for purposes other than recording a round of golf such as, but not by way of limitation, recording a number of practice tee shots at a driving range. Recording a large number of shots in this fashion is helpful for determining how a golfer is hitting the ball, so that a proper diagnosis of the golfer's shot can be made, along with appropriate correction actions such as those described above.

A further aspect of the invention involves a tee marking system including, alone or in conjunction with the tee of the present invention, a permanent mark indicator 140 (FIGS. 3B–3D, 4B–4D) on the club face 42 of a club head 44 that gives the golfer a target 142 of where the tee of the present invention should leave a mark. Many of today's top manufacturers realize the importance of placing the mark 146 that indicates the "sweet spot" of their club. This new mark 140 will insure unparalleled accuracy for the golfer to instantly view the outcome of their swing path and contact area after striking a golf ball. This new mark 140 is placed generally beneath the manufacturer's "sweet spot" indicator 146 in order for the ball to hit the manufacturer's "sweet spot." The reason this new indicator 140 must be placed generally beneath the manufacturer's "sweet spot" indicator is to account for the golf ball's diameter and being placed onto a tee. After a golfer hits a shot and a marking is left on the club face 42 from the tee, the position of the marking with respect to the indicator mark 140 will show the golfer whether the optimal hitting area was achieved.

With reference to FIGS. 6–9, the results from a number of field experiments conducted with the tee marking system 20 will now be discussed. The tee 22 used was coated with a flat enamel based paint sold as Testor flat enamel based paint by The Testor Corporation of Rockford. The unfinished tee was painted using a standard paintbrush (Royal, Golden Taklon, Set AM-Detail, #0.). The colors of the marks 24 were beret green (#1171), yellow (#1169) and red (#1150). The unfinished tees were painted with the three vertical lines illustrated in FIG. 1A, a red line 36(R) on a right portion of the tee 22, green centerline 38(G) and a yellow line 40(Y) on a left portion of the tee 22. The green centerline 38(G) was used as the aiming feature of the tee 22. The tee 22 was placed in the ground and the green line 38(G) was lined up with the intended landing area. The swing tests were performed by a golfer with a right handed swing. Accordingly, the yellow line 40(Y) on the left side of the tee 22 was used to indicate if the swing path was coming too far from the inside and the red line 36(R) on the right side of the green line was used to indicate if the swing path is coming too far outside. When the "sweet spot" of the club head 44 was hit with the correct swing path, a marking including colors from all three lines 24 was left on the club face 42. If the club face 42 only had a marking with a green line 48(G) and a red line 46(R), this indicated that the swing path was too far from the outside. If the club face 42 only had a marking with a green line 48(G) and a yellow line 50(Y), this indicated that the swing path was from the inside-out. The results for twenty-nine swings were collected at a driving range over separate days swinging a Titleist 975d driver and are shown in FIGS. 6A and 6B. FIGS. 6A and 6B show, for each swing, the mark intensity for the resulting marking left on the club face 42, the general vertical location of the marking on the club face 42, the general horizontal location of the marking on the club face 42, the color combination of the marking on the club face 42, the ball flight path resulting from the swing and the ball flight resulting from the swing.

The results from initial swing #'s 1–5 indicate that the golfer was too close to the ball and, thus, hit the ball on the heel portion of the club head 44. To correct this problem, the golfer moved away from the ball one inch for swing #'s 6–9 (See *). This allowed the golfer to strike the ball on the "sweet spot" of the club. The results show that the golfer had an outside-in swing path on swing #'s 1, 4, 7, 9, 10, 12, 13, 16, 18, 20, 23, 25, 27 and 28. This was observed from the resulting red/green markings on the club face 42 for these swings. To correct this problem the golfer closed his stance before swing #'s 3 and 15 and made an inside-out swing path, as indicated by the yellow/green markings on the club face 42 (See ). For swings that went straight-through towards the intended target there was a yellow/green/red marking on the club face 42, which occurred in swing #'s 2, 5, 6, 8, 10, 14, 17, 19, 21, 22, 24, 26 and 29**.

There are three acceptable or successful outcomes when a swing is deemed suitable. The ball will draw, fade or go straight. Only one of the first five swings, i.e., swing # 3, resulted in a successful shot where the swing resulted in a draw, fade or straight shot. In other words, of the first five swings, the success rate was 20%. After looking at the markings on the club face 42 from the first five swings and realizing that the ball was being struck too far on the heel portion of the club face 42, the golfer made an adjustment and moved back away from the ball in his stance. After this adjustment, fifteen of the next twenty-three swings resulted in hitting the ball down the fairway (either straight, fade or draw). Thus, after making adjustments based on the impact position and swing path feedback provided by the tee marking system of the present invention after just five swings, the golfer was able to obtain a success rate of 65% for the next twenty-three swings. This shows that with instant feedback provided by the tee of the present invention, a golfer can make instant adjustments to properly hit an ideal tee shot.

Figure 7:
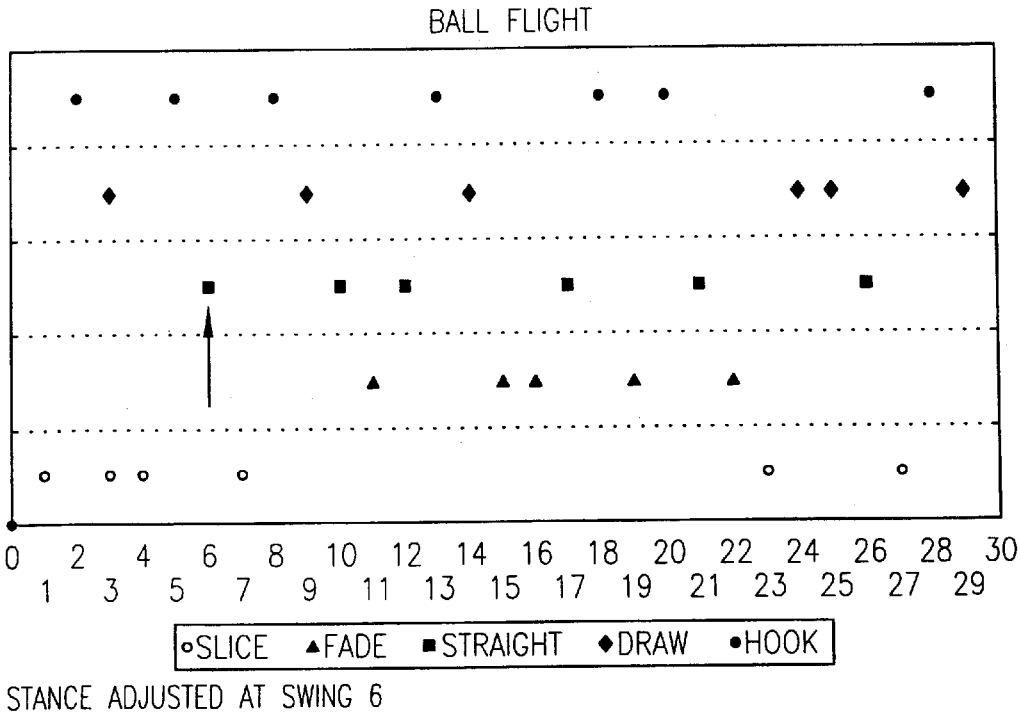
FIG. 7 is a graph illustrating the ball flight path for the test data shown in FIGS. 6A and 6B.
Figure 9:
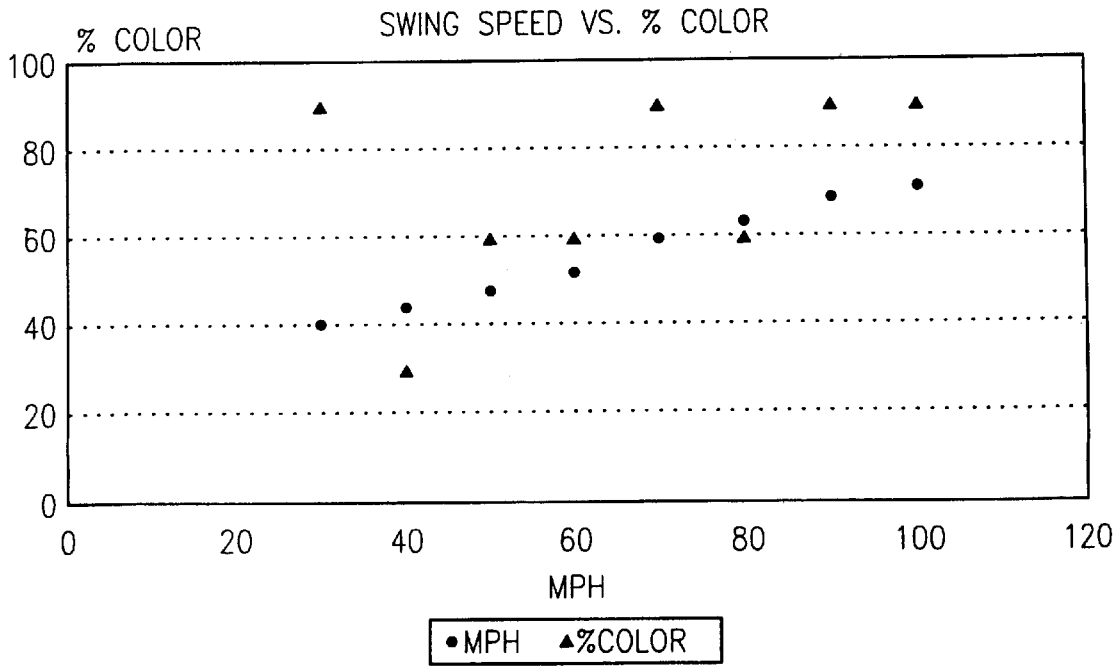
FIG. 9 is a graph illustrating the mark intensity left by colored tees constructed in accordance with an embodiment of the invention for a variety of swing speeds.

FIG. 7 is a graph representing the ball flight path resulting for each swing shown in FIGS. 6A and 6B. FIG. 7 shows that the golfer made an adjustment before swing # 6 based on the impact location and swing path feedback from the tee marking system for the first five shots.

FIG. 8 is a table showing the mark intensity of a resulting marking on the club head 44 for a variety of swing speeds, both for the multi-colored tee of the present invention and a standard white tee manufactured by Pride Manufacturing. The purpose of this experiment was to determine the range of swing speeds that were able to produce a mark on the club face 42. The results showed that the multicolored tee of the present invention made a marking on the club face 42 of the club head 44 while the standard white golf tees only left a mark underneath the club, i.e., on the sole of the club head 44. This is important because the multi-colored tee of the present invention generates more and better feedback of exactly where the point of contact was on the club face 42 after striking a teed golf ball. For example, the muticolored tee shows where the ball was hit horizontally and vertically by the club face 42, and gives swing path information. The standard white tee occasionally gives information about where horizontally on the club head 44 the ball was struck. There were no markings evident on the club face 42, only on the sole plate. The feedback provided by the standard white tee was of limited value. For example, the markings from the standard white tees made it difficult to determine if the ball was hit on the "sweet spot" and gave no indication of swing path on the club face. The results from this swing speed test tends to show that the higher the swing speed, the darker the markings that appear on the club face 42. This is shown graphically in FIG. 9.

FIG. 10 is a table showing the resulting marking intensity on a clubface for a number of golf swings where microcapsules of different sizes were used in conjunction with paint as the mark on the tee. The microcapsules included polyphosphate walls and were obtained from Thies Technology, Inc. of St. Louis, Mo. These microcapsules contained oil soluble red dye and were in the size range of <75 um, <105 um, <150–177 um and <300–600 um. These microcapsules were mixed in various proportions (range 5% v/v to 50% v/v) with Testor flat enamel red (#1150) paint. The mix of dry microcapsules and paint was then applied to a tee using a brush or dipped directly into the mix.

The foregoing description and drawings were given for illustrative purposes only, it being understood that the invention is not limited to the embodiments disclosed, but is intended to embrace any and all alternatives, equivalents, modifications and rearrangements of elements or steps falling within the scope of the invention as defined by the following claims. For example, words such as "first," "second," "third," etc. are used herein to facilitate reader's understanding of the invention, not to limit the scope of the claimed invention.

We claim:

1. A golf tee marking system, comprising:

a head portion having an upwardly concaved socket portion for supporting a golf ball;

an elongated stem portion extending from said head portion for penetration into and support from the ground; and at least said head portion including at least one colored mark adapted to leave a marking on a golf club face from a club swing speed of about 50 mph that is indicative of the impact position of the golf ball on the golf club face.

2. The golf tee marking system of claim 1, wherein the at least one colored mark includes a plurality of colored marks adapted to leave a marking on a golf club face from a club swing that is indicative of the impact position of the golf ball on the golf club face and the golf swing path.

3. The golf tee marking system of claim 2, wherein the plurality of colored marks are adapted to leave a generally non-symmetric marking on the golf club face upon a inside-out or outside-in golf swing path.

4. A golf tee marking system, comprising:

a head portion having an upwardly concaved socket portion for supporting a golf ball;

an elongated stem portion extending from said head portion for penetration into and support from the ground; and at least said head portion including at least one colored mark adapted to leave a marking on a golf club face from a club swing speed of about 50 mph that is indicative of the impact position of the golf ball on the golf club face and the golf swing path.

5. The golf tee marking system of claim 4, wherein the at least one colored mark includes a plurality of colored marks.

6. The golf tee marking system of claim 5, wherein the plurality of colored marks are adapted to leave a generally non-symmetric marking on the golf club face upon a inside-out or outside-in golf swing path.

7. A method for determining the impact position of a golf ball on a golf club face, comprising:

providing a golf tee marking system having a head portion with an upwardly concaved socket portion for supporting a golf ball, an elongated stem portion extending from said head portion for penetration into and support from the ground, and at least said head portion including at least one colored mark adapted to leave a marking on a golf club face from a club swing speed of about 50 mph that is indicative of the impact position of the golf ball on the golf club face;

inserting the golf tee into the ground;

providing a golf ball on the golf tee;

swinging at the golf ball with a golf club at a club swing speed of about 50 mph so that the golf club face impacts the golf ball and the golf tee, leaving a marking on the golf club face; and observing the location of the marking on the golf club face to determine the impact position of the golf ball on the golf club face.

8. A method for determining the impact position of a golf ball on a golf club face, comprising:

providing a golf tee marking system having a head portion with an upwardly concaved socket portion for supporting a golf ball, an elongated stem portion extending from said head portion for penetration into and support from the ground, and at least said head portion including at least one colored mark adapted to leave a marking on a golf club face from a club swing speed of about 50 mph that is indicative of the impact position of the golf ball on the golf club face and the golf swing path;

inserting the golf tee into the ground;

providing a golf ball on the golf tee;

swinging at the golf ball with a golf club at a club swing speed of about 50 mph so that the golf club face impacts the golf ball and the golf tee, leaving a marking on the golf club face; and observing the location of the marking on the golf club face to determine the impact position of the golf ball on the golf club face and the golf swing path.

9. The method of claim 8, wherein the at least one colored mark includes a plurality of colored marks.

10. The method of claim 9, wherein the plurality of colored marks are adapted to leave a generally non-symmetric marking on the golf club face upon a inside-out or outside-in golf swing path.

11. A golf tee marking system, comprising:

a golf tee including a head portion having an upwardly concaved socket portion for supporting a golf ball, an elongated stem portion extending from said head portion for penetration into and support from the ground, and at least said head portion including at least one colored mark adapted to leave a marking on a golf club face from a club swing speed of about 50 mph that is indicative of the impact position of the golf ball on the golf club face; and a club head having a club face with a permanent mark indicating a target area where said golf tee should leave said marking for optimal hitting of the golf ball.

12. The golf tee marking system of claim 11, wherein said club face includes a sweet spot which represents an ideal zone on the club face for hitting the golf ball, and said target area is located generally below said sweet spot.

13. A method for determining the impact position of a golf ball on a golf club face, comprising:

providing a golf tee marking system having a head portion with an upwardly concaved socket portion for supporting a golf ball, an elongated stem portion extending from said head portion for penetration into and support from the ground, and at least said head portion including at least one colored mark adapted to leave a marking on a golf club face from a club swing speed of about 50 mph that is indicative of the impact position of the golf ball on the golf club face;

inserting the golf tee into the ground;

providing a golf ball on the golf tee;

providing a golf club having a club face with a permanent mark indicating a target area where said golf tee should leave said marking for optimal hitting of the golf ball;

swinging at the golf ball with a golf club at a club swing speed of about 50 mph so that the golf club face impacts the golf ball and the golf tee, leaving a marking on the golf club face; and observing the location of the marking on the golf club face in relation to the target area for determining whether optimal hitting occurred.

14. The method of claim 13, wherein said club face includes a sweet spot which represents an ideal zone on the club face for hitting the golf ball, and said target area is located at least partially below said sweet spot.

* * * * *